US007139505B2

(12) United States Patent
Askren et al.

(10) Patent No.: US 7,139,505 B2
(45) Date of Patent: Nov. 21, 2006

(54) TONER HOUSING PLUG WITH TONER LEVEL SENSOR

(75) Inventors: Benjamin Alan Askren, Lexington, KY (US); Peter Alden Bayerle, Lexington, KY (US); Donn Duane Bryant, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/798,929

(22) Filed: Mar. 11, 2004

(65) Prior Publication Data

US 2005/0201776 A1 Sep. 15, 2005

(51) Int. Cl.
*G03G 15/08* (2006.01)

(52) U.S. Cl. ..... 399/106

(58) Field of Classification Search ..... 399/106; 347/140; 49/310, DIG. 2; 215/294, 354
See application file for complete search history.

(56) References Cited

U.S. PATENT DOCUMENTS 4,963,929 A 10/1990 Ueda et al.
5,434,656 A 7/1995 Nagaoka et al.
5,532,790 A 7/1996 Akazawa
5,587,770 A 12/1996 Jo et al.
5,621,221 A 4/1997 Shinohara et al.
5,671,461 A 9/1997 Ishii
5,752,145 A 5/1998 Nakaue et al.
5,812,915 A 9/1998 Farkash
5,870,652 A 2/1999 Kanamori et al.
5,899,597 A 5/1999 Shinohara et al.
5,933,678 A 8/1999 Park
6,075,963 A 6/2000 Ichikawa et al.
6,173,130 B1 1/2001 Oguma
6,219,506 B1 * 4/2001 Morinaga et al. ..... 399/109
6,233,421 B1 5/2001 Wang et al.
6,337,956 B1 1/2002 Sato et al.
6,397,016 B1 5/2002 Katakabe et al.
6,496,662 B1 12/2002 Buchanan et al.
2003/0086715 A1 5/2003 Miura et al.

* cited by examiner

*Primary Examiner*—David M. Gray
*Assistant Examiner*—Laura K. Roth
(74) *Attorney, Agent, or Firm*—Coats and Bennett

(57) ABSTRACT

A toner fill plug for a toner cartridge within an image forming device. The cartridge includes a toner reservoir having a port through which toner is input. The plug is sized to fit within the port and prevent toner leakage. The plug includes a reflector which aligns with an adjacently-positioned toner level sensor for determining the amount of toner remaining within the reservoir. The plug is removable to allow the user to refill the reservoir with new toner.

19 Claims, 5 Drawing Sheets

TONER HOUSING PLUG WITH TONER LEVEL SENSOR

BACKGROUND

Cartridges used in image forming devices include toner to form an image on a media sheet. A number of different sensing mechanisms have been used for detecting the amount of toner remaining within the cartridge. One detection method includes detecting the amount of torque applied to an agitating member that rotates through the toner. The torque on the agitating member can be sensed to determine the remaining amount of toner.

Another method includes optical detecting using an optical sensor that radiates a light beam through a transparent window in the cartridge. In one embodiment, an emitter directs a light beam through an opening in the cartridge. The light beam reflects off a surface within the cartridge and is detected by a sensor positioned next to the emitter. The amount of reflected light determines the remaining amount of toner. In another embodiment, a second opening is positioned in the cartridge opposite from the first opening. The sensor is positioned at the second opening to receive the light beam directly from the emitter. Again, the amount of detected light determines the remaining amount of toner.

The cartridge may be used in the image forming device until the toner is exhausted. The cartridge is then removed from the device and replaced with a new cartridge. The exhausted cartridge is then either discarded, or refilled with new toner. The cartridge should have some manner of gaining access to the interior to allow for new toner to be refilled and used again within the image forming device. The refilling mechanism should provide a durable seal to prevent toner from leaking during the image formation process. The access point should also be positioned at a location on the cartridge to not interfere with the other cartridge mechanisms.

SUMMARY

The present invention is directed to a toner fill plug for a toner cartridge within an image forming device. The cartridge includes a toner reservoir having a port through which toner is input. A plug extends over the port and is sized to seal the port and prevent toner leakage. The plug includes a reflector that is positioned within the reservoir when the plug is mounted to the port. The reflector reflects a signal radiated by an adjacently-positioned toner level sensor for determining the amount of toner remaining within the reservoir. The plug is removable to allow for the user to refill the reservoir with new toner.

DETAILED DESCRIPTION

Figure 1:
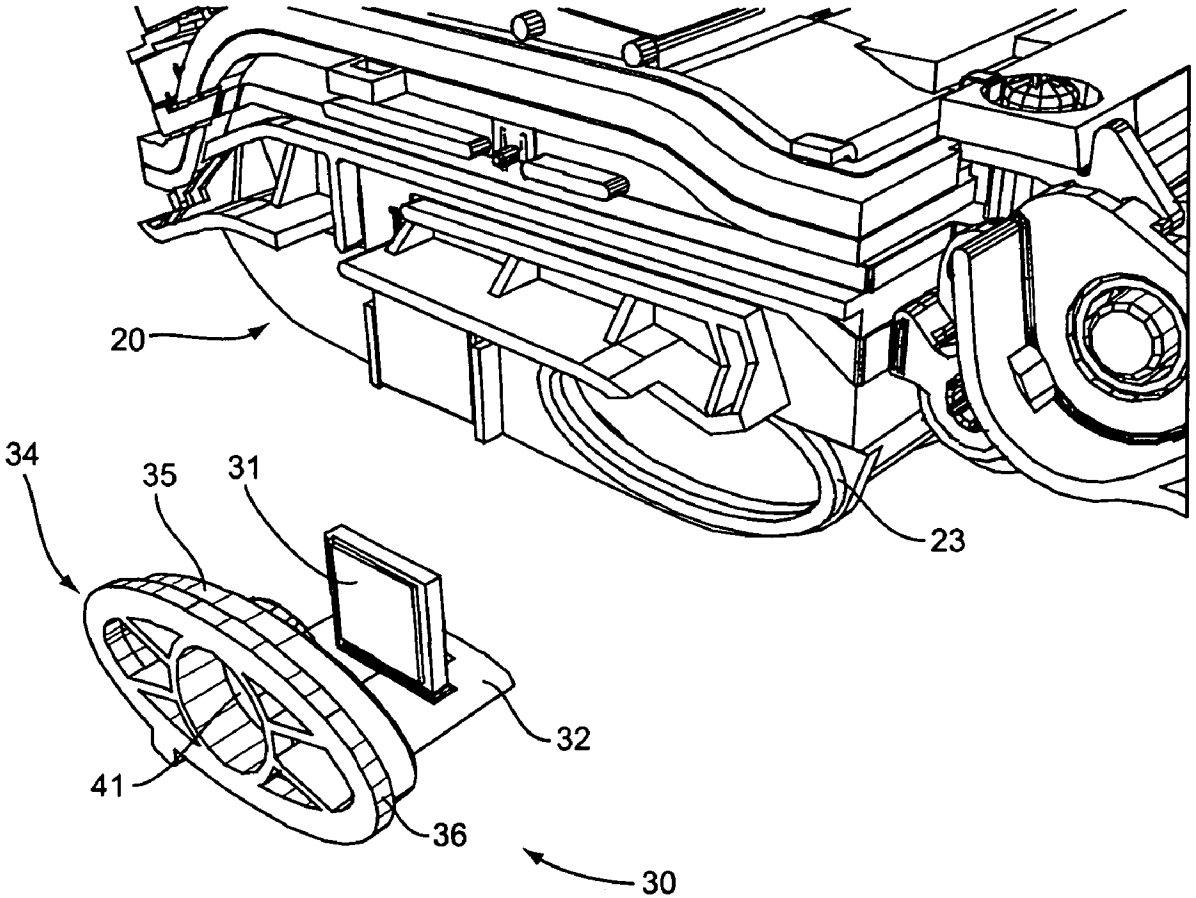
FIG. 1 is an exploded view of the plug removed from the port according to one embodiment of the present invention.
Figure 2:
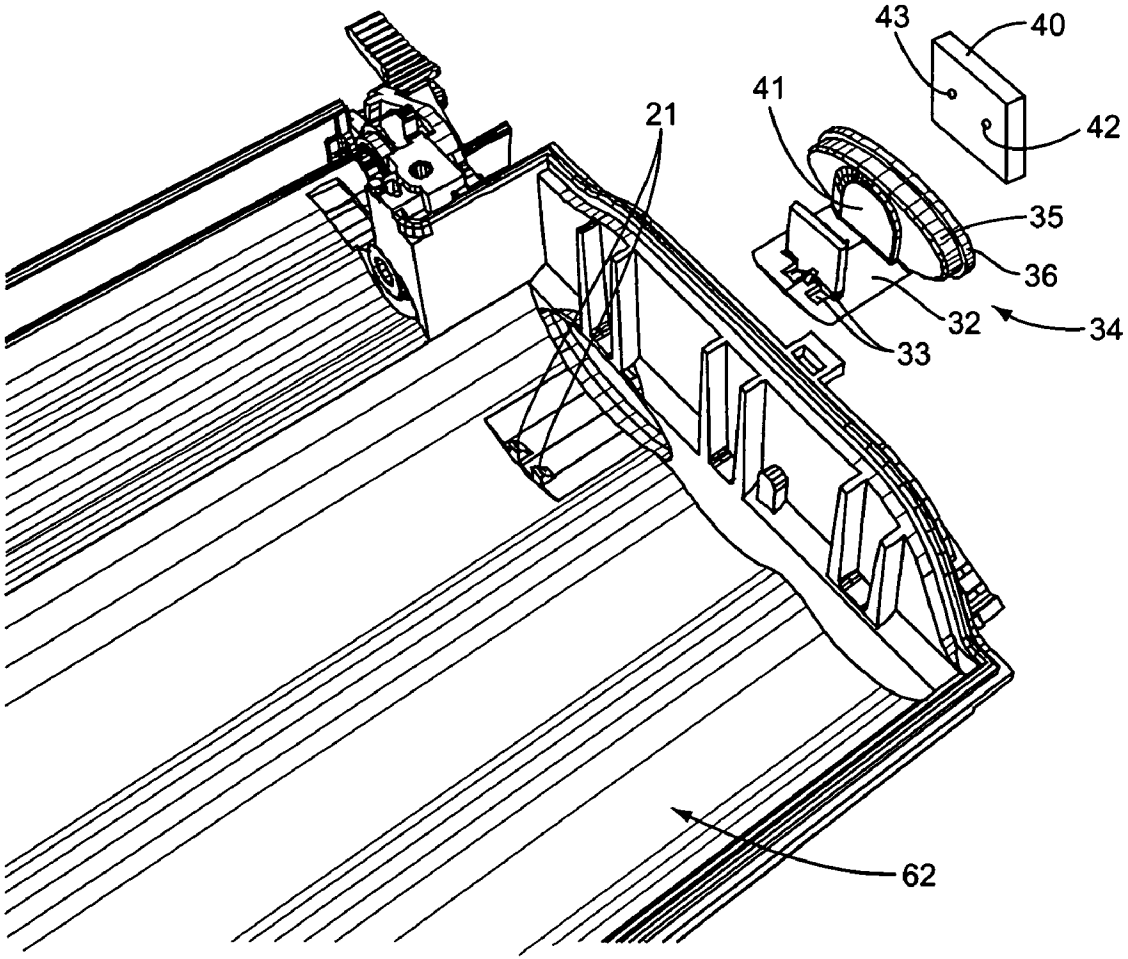
FIG. 2 is a cut-away exploded of the plug removed from the port and the toner level sensor according to one embodiment of the present invention.
Figure 3:
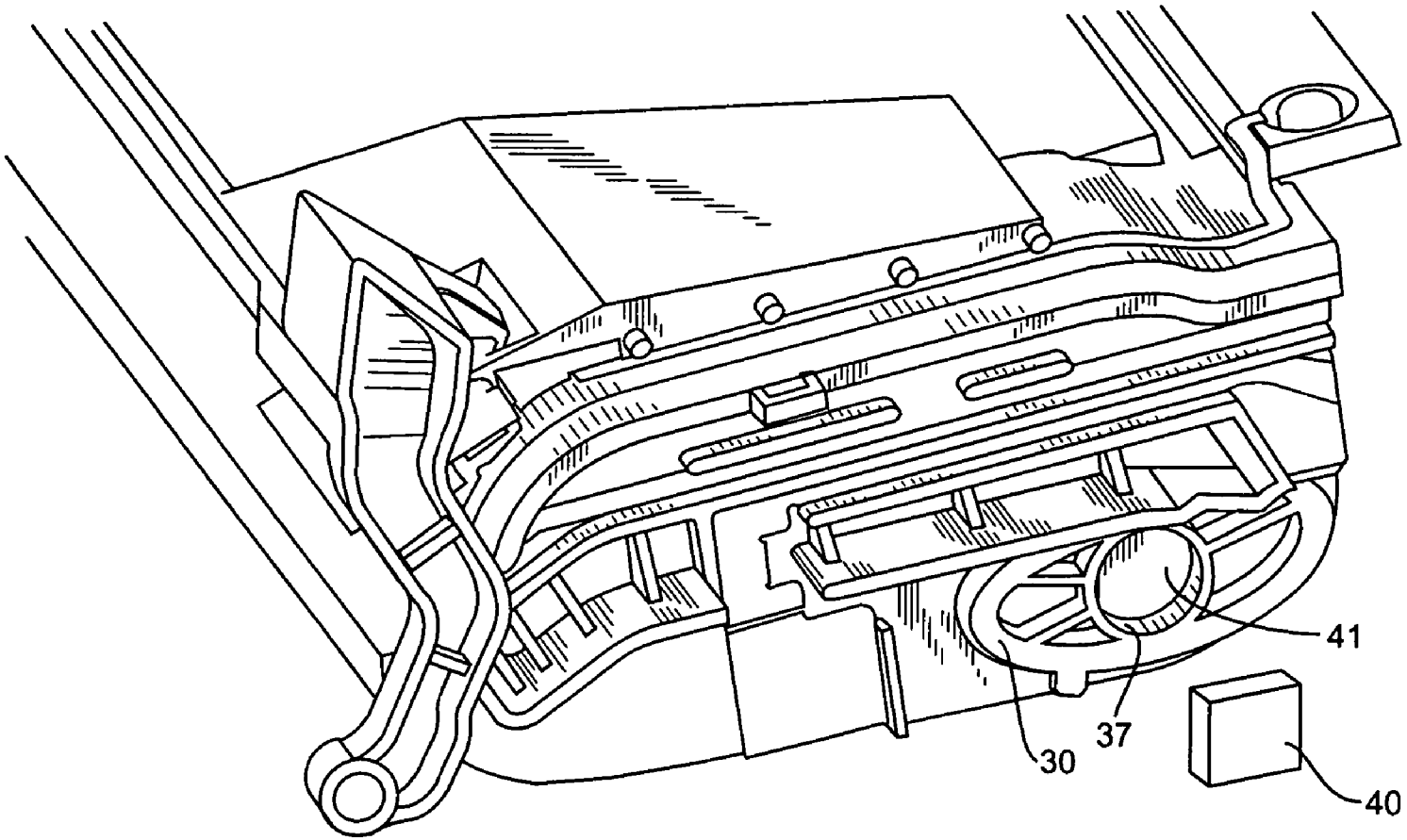
FIG. 3 is a partial perspective view of the plug mounted within the port according to one embodiment of the present invention.
Figure 4:
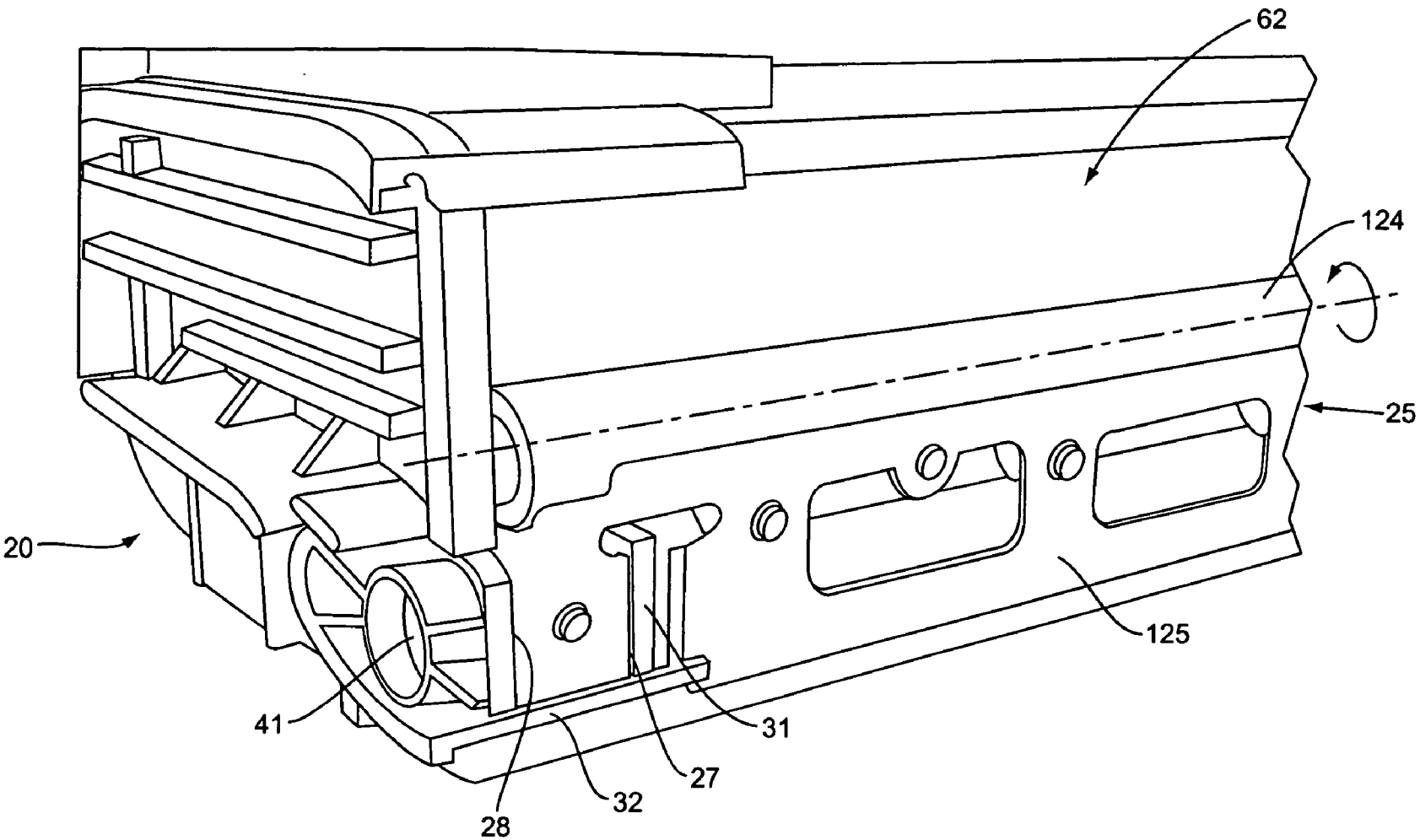
FIG. 4 is a cut-away view of an agitating member contacting the plug on the interior of the cartridge according to one embodiment of the present invention.

The present invention is directed to a toner fill plug 30 that prevents toner from leaking from a port 23 in a toner cartridge 20. The plug 30 includes a reflector 31 that reflects a light signal radiated from a toner level sensor 40 for determining the amount of toner remaining within the cartridge 20. The plug 30 may be removed for refilling new toner into a reservoir 62 within the cartridge 20.

The plug 30 includes a seal 34, base 32, and a reflector 31 as illustrated in FIG. 1. The seal 34 is sized to fit within the port 23 and prevent toner from leaking from the cartridge 20. In one embodiment, the seal 34 has an elliptical shape with a lip 36 and an outer rim 35 that extends around the exterior of the lip 36. When inserted in the port 23, the lip 36 contacts the edge of the port 23, and the outer rim 35 contacts the outer edge of the cartridge 20. An aperture 37 is positioned within the seal 34 to contain a window 41. In one embodiment, the aperture 37 is positioned within the center of the seal 34.

The elliptical shape of the seal 34 seats the lip and outer rim 35 within the port 23. In one embodiment, the elliptical shape has a length major axis of about 30.7 mm and a minor axis of about 14.94 mm. The seal 34 may be constructed from a variety of materials. In one embodiment, the material is elastic to conform to the dimensions of the port 23. In one embodiment, the seal 34 is constructed of a polycarbonate.

Base 32 extends outward from the seal 34. The length of the base 32 may vary depending upon the desired location of the reflector 31. One or more apertures 33 are positioned on a distal end of the base 32 opposite the seal 34.

Reflector 31 extends outward from the base 32 at a predetermined distance from the window 41. In one embodiment, the reflector 31 is spaced from the window 41 a distance of about 9 mm, and should not exceed a distance of more than about 40 mm. The reflector 31 reflects the signal emitted from the toner level sensor 40. The reflector 31 and base 32 may be a one-piece member integrally formed together, or the reflector 31 may be a separate piece attached to the base 32. In one embodiment, the reflector 31 is an aluminized plastic sheet attached to support member. The reflector 31 extends upward from the base 32 at a point between the seal 34 and the apertures 33.

One or more retention features 21 extend outward into the internal reservoir 62. The retention features 21 are sized to mount within the apertures 33 of the base 32 and maintain the plug 30 attached to the cartridge 20. In one embodiment, retention features have a ramped shape with an angled surface that slant away from the port 23.

The port 23 is positioned on the cartridge 20 at a location not to interfere with the elements used in the image formation process, such as the developer roll and toner adder roll. In one embodiment, a bottom edge of the port 23 is substantially aligned with a bottom of the reservoir 62. This position allows the base 32 to slide across the bottom of the cartridge during installation, and for the apertures 33 to mount to the retention features 21 which extend outward from a lower wall of the internal reservoir 62.

An agitating member 25 is positioned within the cartridge 20 to stir and move the toner. The agitating member 25 includes a shaft 124 and a blade 125. The shaft 124 rotates with the blade 125 stirring and moving the toner within the internal reservoir 62. The sweep of the blade 125 extends across the port 23 and plug 30. The blade 125 includes a first edge 27 and a second edge 28 spaced a distance apart. The first edge 27 sweeps across the reflector 31 and the second edge 28 sweeps across the window 41 during each rotation.

The sweeping motion keeps both the reflector 31 and window 41 clear to allow light from the toner level sensor 40 to pass back and forth between the window 41 and reflector 31.

Toner level sensor 40 detects the amount of toner remaining within the cartridge 20. The toner level sensor 40 includes an emitter 42 that radiates infrared light, and a receiver 43 that detects the reflected light from the reflector 31. In one embodiment, the sensor 40 is mounted in the image forming device at a position to be adjacent to the window 41 when the cartridge 20 is installed. In another embodiment, the sensor 40 is attached to the plug 30.

The emitter 42 emits an infrared light through the window 41 towards the reflector 31. A strong reflected signal is received by the receiver 43 when there is no toner within the reservoir 62. No signal or a weak signal is detected by the receiver 43 when toner within the reservoir is to a level to block the light from contacting or being reflected by reflector 31.

Various types of emitters 42 and receivers 43 may be used and are considered within the scope of the present invention. In one embodiment, the emitter 42 and receiver 43 are separate elements.

Window 41 is an optically transmissive member mounted within the aperture 37 of the seal 34. The window 41 may be any material which is transparent to infrared light and is sturdy enough to hold toner within the cartridge 20. In one embodiment, the window 41 is made of polycarbonate. In one embodiment, the window 41 has a surface that is substantially parallel with a reflective surface of the reflector 31

Figure 5:
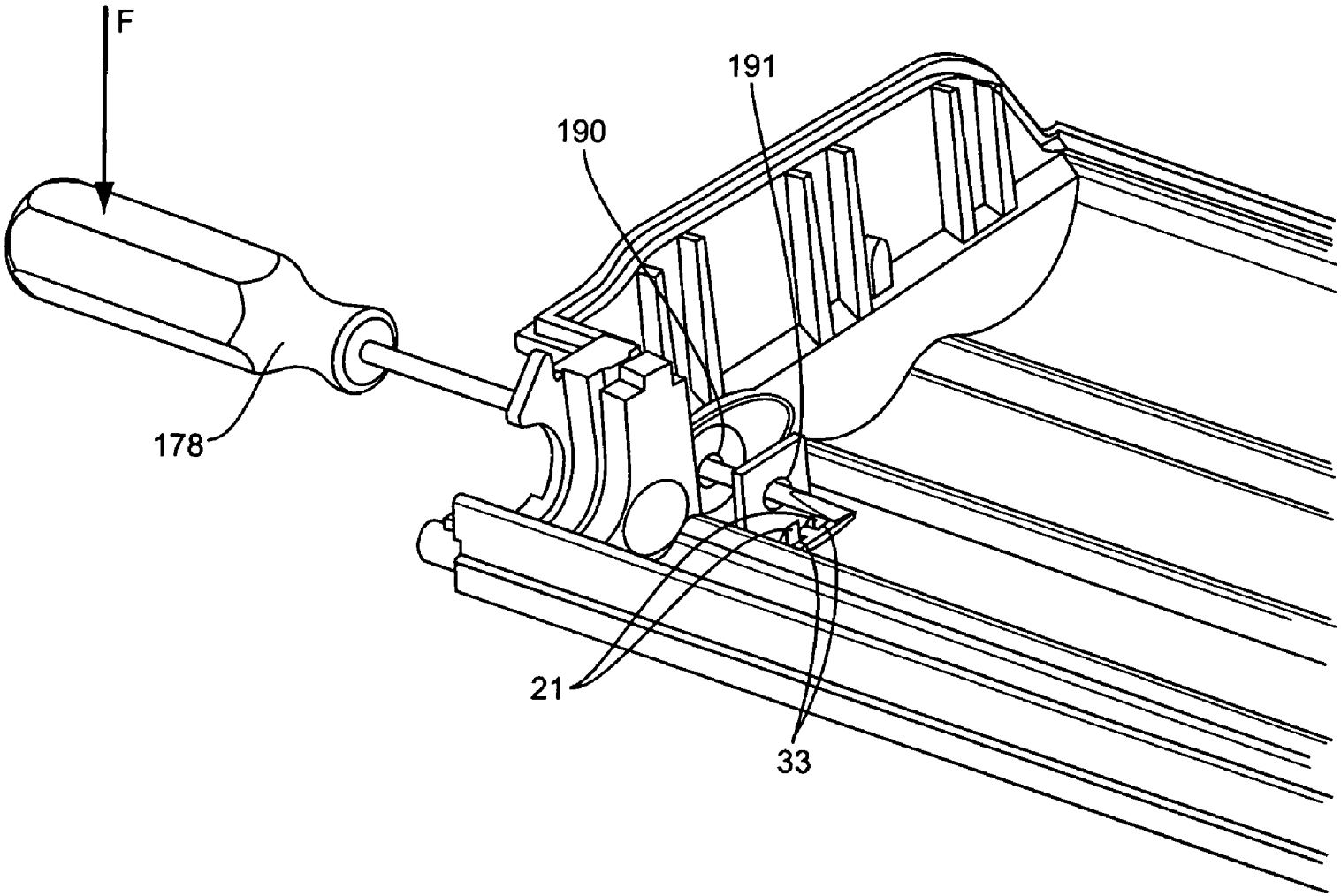
FIG. 5 is a cut-away view of a tool for removing the plug from the port according to one embodiment of the present invention.

Removal of the plug 30 is necessary to refill toner within the cartridge 20. In one embodiment as illustrated in FIG. 5, an opening 190 is formed in the plug 30 for inserting a tool 178, such as a screwdriver. Once inserted, a downward force F is applied to the screwdriver to remove the apertures 33 on the base 32 from the retention features 21 within the cartridge 20. Once removed, the plug 30 can be removed and new toner refilled through the port 23. In one embodiment, a first opening 190 is formed in the seal 34, and a second opening 191 is formed in the reflector 31. In yet another embodiment, the plug 30 can be removed by a user grasping the outer edges of the seal 34 and applying a removal force.

Examples of cartridges for use in the present invention are those found in Printer Model Nos. C750 and C752 available from Lexmark, International, Inc, of Lexington, Ky. U.S. Pat. No. 6,496,662 assigned to Lexmark International Inc discloses other cartridges, plugs, and toner level sensors, and is herein incorporated by reference in its entirety.

Placement of the reflector 31 on the removal plug 30 assists in refilling the cartridge 20 with toner. The reflector 31 is removed with the plug during refilling and does not slow or prevent the toner from entering the cartridge. If the reflector 31 was permanently mounted within the cartridge 20, it may interfere with the refilling process and act as a dam to prevent toner from entering through the port 23.

The present invention may be carried out in other specific ways than those herein set forth without departing from the scope and essential characteristics of the invention. In one embodiment, seal 34 is a separate element that attaches to the body of the plug 30. In another embodiment, additional sealing elements such as neoprene, felt, or caulk prevent toner leakage. These additional sealing elements may be attached to the plug 30, to the cartridge 20, or applied separately. The present embodiments are, therefore, to be considered in all respects as illustrative and not restrictive, and all changes coming within the meaning and equivalency range of the appended claims are intended to be embraced therein.

What is claimed is:

1. A device to prevent toner from leaking from a cartridge of an image forming apparatus comprising:

a seal sized to fit within a port in the cartridge, the seal having an aperture;

an optically transmissive member positioned across the aperture;

a base extending outward from the seal and having a connection member; and a reflector extending from the base and having a reflective surface positioned a distance from the optically transmissive member.

2. The device of claim 1, wherein the seal has an elliptical shape.

3. The device of claim 2, wherein the aperture is centered within the seal.

4. The device of claim 1, wherein the connection member is an aperture formed in the base.

5. The device of claim 1, wherein the reflector extends outward from the base between the seal and the connection member.

6. The device of claim 1, wherein the optically transmissive member and the reflector form surfaces that are substantially parallel.

7. A toner cartridge for use in an image forming device comprising:

a port positioned through an exterior wall;

an agitating member having a wiper blade with a first edge and a second edge that are spaced apart;

a seal sized to mount within the port and prevent toner from leaking;

an optically transmissive member positioned within an opening in the seal;

a base extending outward from the seal; and a reflector having a reflective surface and extending from the base to be spaced from the optically transmissive member for the first edge to contact the reflective surface and the second edge to contact the optically transmissive member.

8. The cartridge of claim 7, further comprising a retention feature mounted on an inner wall of the cartridge to receive a connection member on the base.

9. The cartridge of claim 8, wherein the retention feature comprises an angled member extending from an inner wall of the cartridge and the connection member comprises an aperture within the base.

10. The cartridge of claim 9, wherein the aperture is positioned on a distal end of the base opposite the seal.

11. The cartridge of claim 7, wherein the port is positioned adjacent to a lower wall of the cartridge with the base resting on the lower wall when the seal is mounted within the port.

12. The cartridge of claim 7, wherein a first distance between the first edge and the second edge is equal to a second distance between the optically transmissive member and the reflective surface.

13. An image forming device comprising:

a cartridge having a toner reservoir and a port to access the toner reservoir;

a toner level sensor positioned adjacent to the port to send signals through the port; and a plug mounted to block the port and having an optically transmissive section that aligns with the toner level sensor, a base that extends into the toner reservoir when the plug is mounted to the port, and a reflector that extends from the base and has a reflective surface positioned a distance from the optically transmissive section.

14. The device of claim 13, further comprising a retention feature mounted within the toner reservoir a predetermined distance from the port and a connection member on the base that mates with the retention feature when the plug is mounted to the port.

15. The device of claim 13, further comprising an agitating member rotatably mounted within the toner reservoir and having a first edge and a second edge, the agitating member rotatably mounted with the first edge contacting the reflective surface and the second edge contacting the optically transmissive section.

16. The device of claim 13, wherein the toner level sensor is positioned a predetermined distance from the reflective surface when the plug is mounted to the port.

17. A method of removing a plug from a cartridge of an image forming device, the method comprising the steps of:

forming a hole in an optically transmissive section of a plug that is mounted within a port in the cartridge;

extending a tool through the hole and partially into an interior section of the cartridge;

applying a force to the tool at an angle substantially parallel to a face of the plug;

disconnecting a connection member on a base that extends outward from the plug from a retention feature mounted within the interior section of the cartridge;

removing the plug from the port; and forming a second hole in a reflective member that extends from the base a distance from the plug and extending the tool through the hole and through the second hole prior to applying the force.

18. The method of claim 17, further comprising inputting new toner into the cartridge after removing the plug from the port.

19. A method of mounting and removing a plug from a cartridge of an image forming device, the method comprising the steps of:

mounting a plug within a port on the cartridge by positioning a seal within the port and attaching an aperture on the plug to a ramped member that extends outward from a wall within a toner reservoir;

aligning an optically transmissive member on the plug with a toner level sensor within the image forming device;

forming a hole in the plug and inserting a tool through the hole and into the toner reservoir;

applying a force to the tool to disengage the ramped member from the aperture; and removing the plug from the port.

* * * * *